US006156396A

United States Patent [19]

Florian

[11] Patent Number: 6,156,396

[45] Date of Patent: Dec. 5, 2000

[54] GOLF PRACTICE MAT

[76] Inventor: Raymond Florian, 14440 Elwell, Belleville, Mich. 48111

[21] Appl. No.: 09/132,588

[22] Filed: Aug. 11, 1998

[51] Int. Cl.[7] ..... A63B 69/36

[52] U.S. Cl. ..... 428/17; 473/278

[58] Field of Search ..... 428/17, 15, 95, 428/88; 473/278, 279

[56] References Cited

U.S. PATENT DOCUMENTS

| | | | |
|---|---|---|---|
| 3,348,847 | 10/1967 | Fischl | 273/186 |
| 4,311,312 | 1/1982 | O'Brien | 473/279 |
| 4,387,896 | 6/1983 | O'Brien | 428/17 |
| 4,497,853 | 2/1985 | Tomarin | 428/17 |
| 4,637,942 | 1/1987 | Tomarin | 428/17 |
| 4,913,442 | 4/1990 | Walker | 473/278 |
| 5,443,870 | 8/1995 | Lurie et al. | 428/17 |

*Primary Examiner*—Alexander Thomas
*Attorney, Agent, or Firm*—Charles W. Chandler

[57] ABSTRACT

A golf practice mat includes a relatively thick base pad formed of a resilient elastomeric material, e.g. foam rubber, and an artificial grass carpet slidably positioned on the base pad. An elastic biasing mechanism is provided for positioning the carpet on the pad. When a golf ball on the carpet surface is forcibly struck, the carpet can slide a limited distance to absorb the club force, so as to lessen the reaction force onto the golfer's hands and arms. The elastic biasing mechanism then returns the carpet to its original position.

8 Claims, 1 Drawing Sheet

GOLF PRACTICE MAT

BACKGROUND AND SUMMARY OF THE INVENTION

This invention relates to a golf practice mat, and particularly to a golf practice mat having shock-absorption features for minimizing ground reaction forces onto the golfer's hands and arms.

Golf practice mats are already known in the prior art.

U.S. Pat. No. 3,348,847, to Frederick Fischl, shows a golf practice mat having a simulated divot that allows the golf club head to continue down into the mat after striking the golf ball.

U.S. Pat. No. 5,443,870, to Lewis Lurie and James W. Lyman discloses a golf mat having an upwardly bulged hill that allows the golfer to practice side hill shots, uphill shots, or downhill shots.

U.S. Pat. No. 4,497,853, to Seymour A. Tomarin, shows a golf mat that includes a simulated grass upper layer having a sand filler, a water barrier sheet, and a springy fibre base layer.

The present invention relates to a golf practice mat that includes a base pad formed of a resilient compressible material, e.g. plastic foam, and an artificial grass carpet slidably positioned on the pad upper surface, whereby the grass carpet shifts along the pad when struck by a golf club during a practice golf swing.

The golf practice mat of this invention has shock-absorbing features that produce essentially the same feeling as hitting the golf ball off soft bent grass fairway turf. The mat has been developed to produce good ball contact while avoiding club head bounce off a hard mat surface. An advantageous effect is to minimize potential pain and/or injury to the golfer's hands or arms, resulting from jarring contact between the golf club head and the mat surface.

Further features of the invention will be apparent from the attached drawings and description of an illustrative embodiment of the invention.

DESCRIPTION OF A PREFERRED EMBODIMENT OF THE INVENTION

Figure 1:
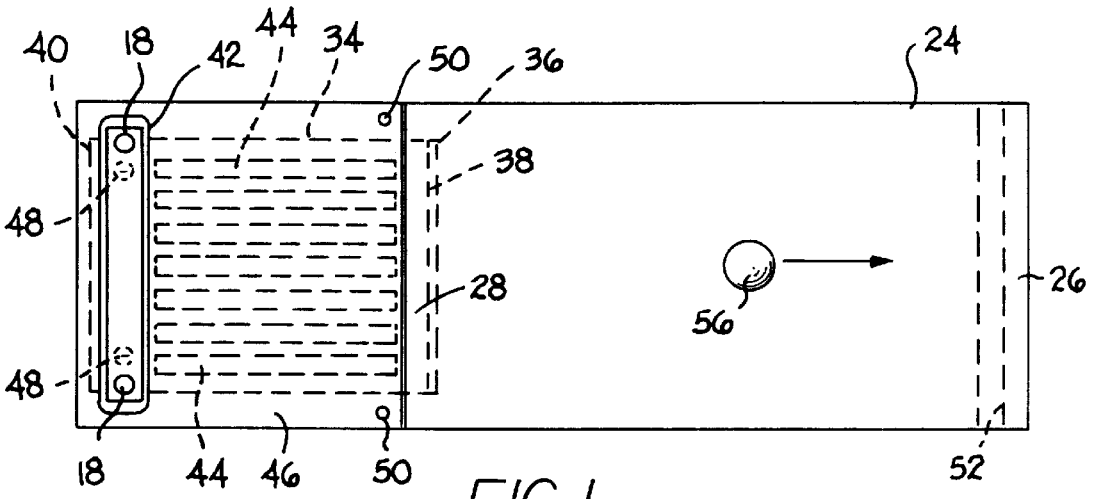
FIG. 1 is a top plan view of a golf practice mat constructed according to the invention.
Figure 2:
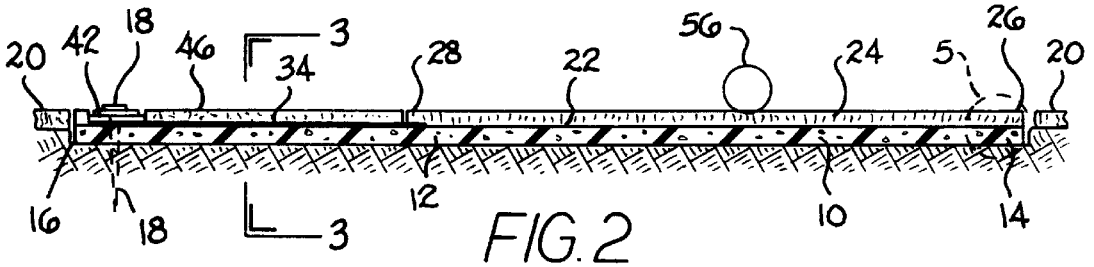
FIG. 2 is a sectional view taken on line 2—2 in FIG. 1.

FIGS. 1 and 2 shows a rectangular golf practice mat that includes a base pad 10 formed of a resilient material, e.g. an elastomeric plastic foam material, or an elastomeric rubber foam material.

Pad 10 is positioned on a suitable rigid support surface, e.g. hard earth or concrete 12. Pad 10 has a first free end 14 and a second end 16 that may be rigidly anchored to support surface 12 by two or more spikes 18. The ground area around the practice mate can be overlaid with live (growing) grass 20.

The upper surface of pad 10 has a covering layer 22 formed of an anti-friction (slippery) material, e.g. a smooth-surface plastic film laminated onto the pad 10 upper surface.

Anti-friction layer 22 preferably extends substantially the entire length and width of pad 10.

Slidably positioned on anti-friction layer 22 is an artificial grass carpet 24 having a first end 26 coextensive with end 14 of pad 10. Grass carpet 24 has a second end 28 spaced a significant distance to the right of pad end 16. Thus, artificial grass carpet 24 has a length dimension that is appreciably less than the length dimension of pad 10. The width dimension of artificial grass carpet 24 can be the same as the width dimension of pad 10, whereby the pad forms a resilient supporting surface underlying the entire lower surface of artificial grass carpet 24.

Artificial grass carpet 24 can be a commercially available carpet material used as an artificial turf for various sporting activities, e.g. football or baseball. Artificial grass carpet materials are shown in various United States patents, e.g. U.S. Pat. No. 4,637,942 issued to Seymour A. Tomarin, U.S. Pat. No. 1,939,846 issued to Frank Fenton, and U.S. Pat. No. 5,443,870 issued to Lewis Lurie and James W. Lyman. A preferred artificial grass carpet for use in the present invention is a material available from Grass Tex, Inc. of Dalton, Ga., under the name of Hi Tec Turf.

The artificial grass carpet includes backing sheet 30 that serves as an anchorage for closely spaced fibre strands 32, formed e.g. form nylon, polypropylene, or polyester. Backing sheet 30 can be woven or non-woven. The artificial grass carpet 24 simulates natural grass.

Figure 3:
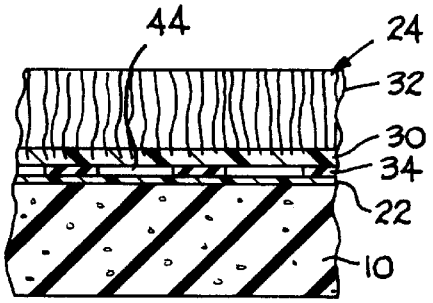
FIG. 3 is a fragmentary enlarged sectional view taken on line 3—3 in FIG. 2.

The left end 28 of the artificial grass carpet 24 is connected to the left end 16 of foam pad 10 by a resilient connecting means 34. As shown in FIGS. 1 and 3, resilient connecting means 34 comprises a thin sheet of rubber sandwiched between carpet backing sheet 30 and the anti-friction layer 22 on pad 10.

Rubber sheet 34 has a right end area 36 attached to carpet backing sheet 30, e.g. by stitching 38, and a left end area 40 attached to pad 10, e.g. by adhesives and/or a clamping plate 42. The rubber sheet (or band) has plural spaced slots 44 therethrough for separating the sheet into separate tension elements that exert a leftward pulling force on artificial grass carpet 24.

Clamping plate 42 is positioned on the upper surface of a second immovable section 46 of artificial grass carpet. Suitable rivets 48 extend through plate 42 and carpet section 46 into foam pad 10, to anchor rubber band (sheet) 34 and carpet section 46 to the foam pad. Additional rivets 50 at the rightmost corners of carpet section 46 further secure the carpet section 46 to pad 10. However, rubber sheet 34 is otherwise free to stretch or contract in the space between anchorage points 38 (on carpet 24) and 48 (on pad 10).

Carpet section 46 is ornamental in nature; its principal function is to overlie and conceal the elastic connector means 34 without interfering with the desired stretching action. Carpet section 46 also abuts end 28 of carpet 24 to limit leftward motion of the carpet by the elastic band 34.

Figure 5:
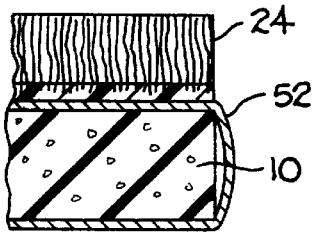
FIG. 5 is a fragmentary enlarged partial view taken on line 5 in FIG. 2.

End 26 of artificial grass carpet 24 is loosely attached to end 14 of pad 10 by a flexible connector sheet 52. As shown in FIG. 5, one end area of sheet 52 is affixed to the undersurface of carpet 24. The other end area of sheet 52 is affixed to the undersurface of pad 10, as by stitching or adhesives. Sheet 52 has some slack therein, such that carpet 24 can slide a limited distance on the upper anti-friction surface of the pad. In the normal position of carpet 24, the elastic band 34 exerts a leftward pulling force on carpet 24 so that attachment sheet 52 lies close against the end edge of pad 10, as shown in FIG. 5.

In use of the illustrated golf practice mat, the golfer positions the golf ball 56 approximately centrally on the artificial grass carpet 24, and then takes a golfing stance alongside the mat. The golf swing is directed so that the ball is driven to the right, as indicated by arrow 58.

Figure 4:
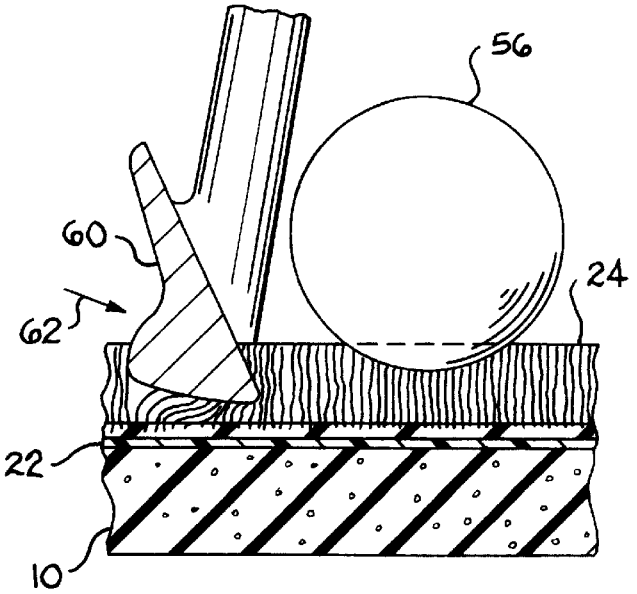
FIG. 4 is a fragmentary enlarged sectional view taken through the FIG. 1 golf practice mat, showing the interaction of the mat with the head of a golf club during an illustrative golf swing.

If the golf club head should strike the ball cleanly, with minimal contact between the club head and carpet 24 then carpet 24 will remain motionless (undisturbed) on pad 10. FIG. 4 illustrates a club mishit, wherein the club head 60 has a descending motion downwardly toward pad 10 in back of the ball, as indicated by arrow 62. As the club head descends into the carpet 24 it moves the carpet a slight distance to the right against the pulling action of elastic connector means 34. The carpet absorbs the club head force without exerting an abnormally high reaction force back onto the club head. Some force absorption is provided by pad 10. However, additional force absorption is provided by slidable deflection of the carpet. This slidable deflection of the carpet on pad 10 lessens stress on the golfer's hands and arms, and thus makes the golfing experience more enjoyable.

The slidable deflection of carpet 24 along pad 10 also tends to reduce club head bounce. When the club head strikes a fixed carpet surface, the reaction force of the fixed surface against the club head tends to deflect the head upwardly as a bouncing effect is considerably reduced or eliminated.

A principal advantage of the invention is the slidable positionment of the artificial grass carpet 24 on the resilient pad 10. The resilient restoring means 34 returns the carpet to its original position after the golf club has driven the ball off the carpet or otherwise been disengaged from the carpet surface.

Having described my invention, I claim:

1. A golf practice mat comprising:

a base pad formed of a resilient material;

said pad having a flat upper surface;

an anti-friction layer on the pad upper surface;

an artificial grass carpet slidably positioned on said anti-friction layer;

said carpet having a first end and a second end;

means loosely attaching said first end of the carpet to said pad; and resilient means trained between said pad and the second end of said carpet for pulling the carpet along the anti-friction layer away from said loose attaching means, whereby said carpet can shift in the direction of said loose attaching means when struck by a golf club;

said resilient means being operable to return said carpet to its original position after the golf club has been disengaged from the carpet.

2. The golf practice mate of claim 1, wherein said resilient means comprises an elastomeric band having one end anchored to said pad and another end anchored to said grass carpet.

3. The golf practice mat of claim 1, wherein said resilient means comprises an elastomeric band having one end anchored to said pad and another end anchored to said grass carpet; said elastomeric band being sandwiched between said anti-friction layer and said grass carpet.

4. The golf practice mat of claim 3, wherein said pad has a longitudinal dimension and a width dimension; said elastomeric band being stretchable in the longitudinal dimension of said pad.

5. The golf practice mat of claim 3, wherein said pad and said carpet have a longitudinal axis and transverse axis; said elastomeric band being anchored to said pad and said carpet so as to stretch along the pad longitudinal axis.

6. The golf practice mat of claim 1, wherein said resilient means comprises an elastomeric band having one end anchored to said pad and another end anchored to said grass carpet; said elastomeric band being located between said anti-friction layer and said grass carpet; said elastomeric band having a stretch axis and plural parallel slots extending in the direction of said stretch axis.

7. The golf practice mat of claim 1, wherein said attaching means comprises a flexible connector sheet having a first portion thereof secured to said artificial grass carpet and a second portion secured to said base pad.

8. The golf practice mat of claim 1, wherein said base pad is formed of an elastomeric foam material.

* * * * *